US006629488B2

(12) United States Patent
Hugelman

(10) Patent No.: US 6,629,488 B2
(45) Date of Patent: Oct. 7, 2003

(54) METHOD AND APPARATUS FOR CONTROLLING AXIAL DEVICE

(75) Inventor: Rodney D Hugelman, Champaign, IL (US)

(73) Assignee: Whitemoss, Inc., West Lafayette, IN (US)

( * ) Notice: Subject to any disclaimer, the term of this patent is extended or adjusted under 35 U.S.C. 154(b) by 0 days.

(21) Appl. No.: 09/874,260

(22) Filed: Jun. 6, 2001

(65) Prior Publication Data

US 2002/0184998 A1 Dec. 12, 2002

(51) Int. Cl.[7] ..... F01B 13/04
(52) U.S. Cl. ..... 92/12.2; 91/506; 74/839
(58) Field of Search ..... 92/12.2; 91/506; 74/839

(56) References Cited

U.S. PATENT DOCUMENTS 3,486,454 A * 12/1969 Tuzson ..... 92/12.2
4,455,920 A * 6/1984 Shaw et al. ..... 92/12.2
5,724,879 A 3/1998 Hugelman
5,894,782 A 4/1999 Nissen et al.
5,960,697 A * 10/1999 Hayase et al. ..... 92/12.2
5,979,294 A * 11/1999 Hugelman ..... 92/12.2
6,206,650 B1 * 3/2001 Thurner ..... 92/12.2
6,283,721 B1 * 9/2001 Gollner ..... 92/12.2
6,312,231 B1 * 11/2001 Kuhne et al. ..... 92/12.2

OTHER PUBLICATIONS http://www.whitemosspumps.com. Click on "$CO_2$ Systems" Hugelman, Rodney D. Drawing posted Jun. 6, 2000.

* cited by examiner

*Primary Examiner*—Edward K. Look
*Assistant Examiner*—Michael Leslie
(74) *Attorney, Agent, or Firm*—Knechtel, Demeur & Samlan

(57) ABSTRACT

A control system, method and apparatus are provided in which a wobble plate assembly is adjustably mounted on a piston and cylinder stroke control assembly. The wobble plate assembly is adjustable through various positions relative to the base, thus providing an adjustable tilt angle to the wobble plate assembly and different strokes for the pumping pistons. In another embodiment the wobble plate assembly is affixed to a clearance volume control assembly, thus providing for simultaneous, independent adjustment of piston stroke and clearance volume of the axial device.

20 Claims, 3 Drawing Sheets

METHOD AND APPARATUS FOR CONTROLLING AXIAL DEVICE

BACKGROUND OF THE INVENTION

Fluid pumps, whether for liquids or gases, may be of the axial type, wherein a plurality of cylinders and pumping pistons are aligned parallel to and disposed around a central axis. The pumping pistons are actuated successively and with their strokes overlapping in time to provide continuous pumping of the working fluid.

One method and means of controlling piston actuation is to provide a wobble plate or swash plate, which is tilted relative to the pump axis. The plate engages the pumping piston and cylinder assemblies so as to actuate each one successively as rotation, of the wobble plate on one hand or the piston and cylinder assembly on the other hand, takes place.

Typical adjustable wobble plate designs for axial pumps generally make use of a tilt platform with a pin-ended bearing support along the tilt axis. An external mechanism is then used to rotate the pin-ended platform. This configuration requires the tilt platform and pin-ended bearing structures to support the full pump thrust loads. Structural rigidity and dynamic performance are compromised with an accompanying increase in pump vibration, noise, and small stroke dynamic stability. An unnecessarily large pump envelope is required to accommodate this approach adding to pump cost and size while further exacerbating rigidity and noise problems.

If the mechanism is not sufficiently rigid, pumping load distortions of the cantilevered swash plate can be significant and of the same order as the stroke for small displacement. This leads to control instability. If the mechanism is sufficiently rigid it is also likely to be heavy and reduce response time as well as increase weight and cost.

A further difficulty with present axial configurations is that the tilt mechanism pivot axis used for the swash plate does not pass through the center of the plane of the swash plate. The yoke is then controlled by a hydraulic tilt cylinder or other thruster at one edge. This provides for the most convenient configuration under the circumstances but results in increasing offset of the swash plate centerline as the swash plate is tilted. Special bearing and support mechanisms must then be added to compensate for this and to force the centered alignment of the piston rods. In some cases centering is maintained by a ball and socket arrangement with a ball attached to the rotating drive shaft and a mating socket on the swash plate. This approach, which is common, introduces undesirable axial loading as well as structural bending moments to the shaft.

Further, the offset swash plate pivot swings the swash plate from side to side requiring additional side clearance within the case for the swinging yoke basket, which adds further to weight and cost.

By replacing the suspended pin-ended yoke assembly with a double wedge mechanism, as provided in U.S. Pat. No. 5,724,879, a more robust, compact and rigid tilt platform is presented to the spinning swash plate. One embodiment of this approach is shown in FIG. 1. This provides several advantages over conventional approaches:

Smaller, simpler, more robust case and pump assembly

Potentially lower cost

Clearance volume need not change with tilt

No external actuators required to achieve tilt

Hydraulic support of the swash plate is possible

Potential for reduced noise

Center of the swash plate remains fixed at all tilt angles

Large tilt angles (stroke) are easily achieved

Control forces need only rotate the wedges

No pin-ended yoke bearings

No high point-load bearing problems

No assembly alignment problems

The double wedge assembly is very adaptable to axial pump design. It can provide the basis for a totally new pump design, or be easily adapted to retrofit many existing axial pumps.

FIG. 1 shows a sectional view of a typical retrofit installation using a stroke control assembly and a double wedge assembly. To retain the use of all other pump components without modifications, the wedge stack must be thick enough to present the tilt plane at the same center location as the original pump yoke assembly. A pump retrofit design using the compact wedge assembly may have a shorter case as well as a smaller diameter case while still retaining the original pump assembly of ports, cylinders and pistons.

Generally, the system provides a compact, rigid and robust replacement for typical pin-ended yoke tilt assemblies for adjustable axial pumps. This improved rigidity and stiffness should reduce vibration and noise. The inherent simplicity should also lead to lower cost of production while improving durability. In design of an actual system, specific analysis of specific frictional moments, static and dynamic loading and hydraulic control parameters will be required.

In addition, typical axial devices have no means for controlling clearance volume of the device. In typical axial pumps the clearance volume increases with decrease in stroke, a situation particularly not desirable in pumping gaseous fluids. Control of clearance volume would have utility in axial devices that use a gas as the working fluid. Such control would be of particular value in air-conditioning and refrigeration systems.

It is one objective of this invention to provide a tiltable flat surface platform wherein pump thrust loads are directly and hydrostatically supported, thereby eliminating the need for pin-ended bearing support along or perpendicular to the tilt axis and the other pump design considerations required of pin-ended bearing support.

It is another objective of this invention to provide a hydrostatically supported tiltable flat surface platform wherein the zero tilt position is moveable with respect to the pumping piston and cylinder assembly thereby providing a means for controlling clearance volume, as well as displacement, of the device. This feature will be of particular utility in gas compressors used in air-conditioning and refrigeration systems and more specifically in such systems where a transcritical gas such as carbon dioxide, i.e., $CO_2$, is used as the refrigerant.

SUMMARY OF THE INVENTION

A new method and apparatus for control of stroke and clearance volume in axial devices is presented which corrects typical shortcomings while offering new possibilities to axial device performance. The new control module is compact, self-contained, and without the need for external tilt control mechanisms. By providing a new adjustable wobble plate with hydraulic support, pin-ended bearings and cantilevered tilt platforms are no longer needed. Device rigidity is improved and vibrations are absorbed by the hydraulic support and device envelope size and noise are minimized. Additional possibilities are then available to dynamically control device timing, promising further improvements in device performance and noise control. These and other advantages of the invention will be apparent from the following detailed description with reference to the appended drawings.

DETAILED DESCRIPTION

In order to assist in a fuller understanding of the above and other aspects of the present invention, the embodiments will now be described, by way of example only, with reference to the accompanying drawings as a variable axial piston machine. The description will, for the most part, describe the machine as a pump or compressor. However, those skilled in the art will readily perceive the utility of the machine as a motor where power input and output are interchanged.

It is an object of the invention to provide a control system, method and apparatus for axial devices having a drive shaft with an axis of rotation and a plurality of pistons parallel to and surrounding an extension of said shaft of rotation beyond said drive shaft, comprising a base member encompassing said axis of rotation, and a control piston adjustably fitted within said base member, said control piston being in driving contact with a means for adjustably tilting a flat surface, said flat surface being in driving relationship to said plurality of pistons, whereby adjustment of said control piston relative to said base member adjusts the angle formed by said flat surface to control movement of said plurality of pistons.

Double Wedge Wobble Plate

In one embodiment of the instant invention, a double wedge assembly provides the means for adjustably tilting the aforesaid flat surface.

Figure 1:
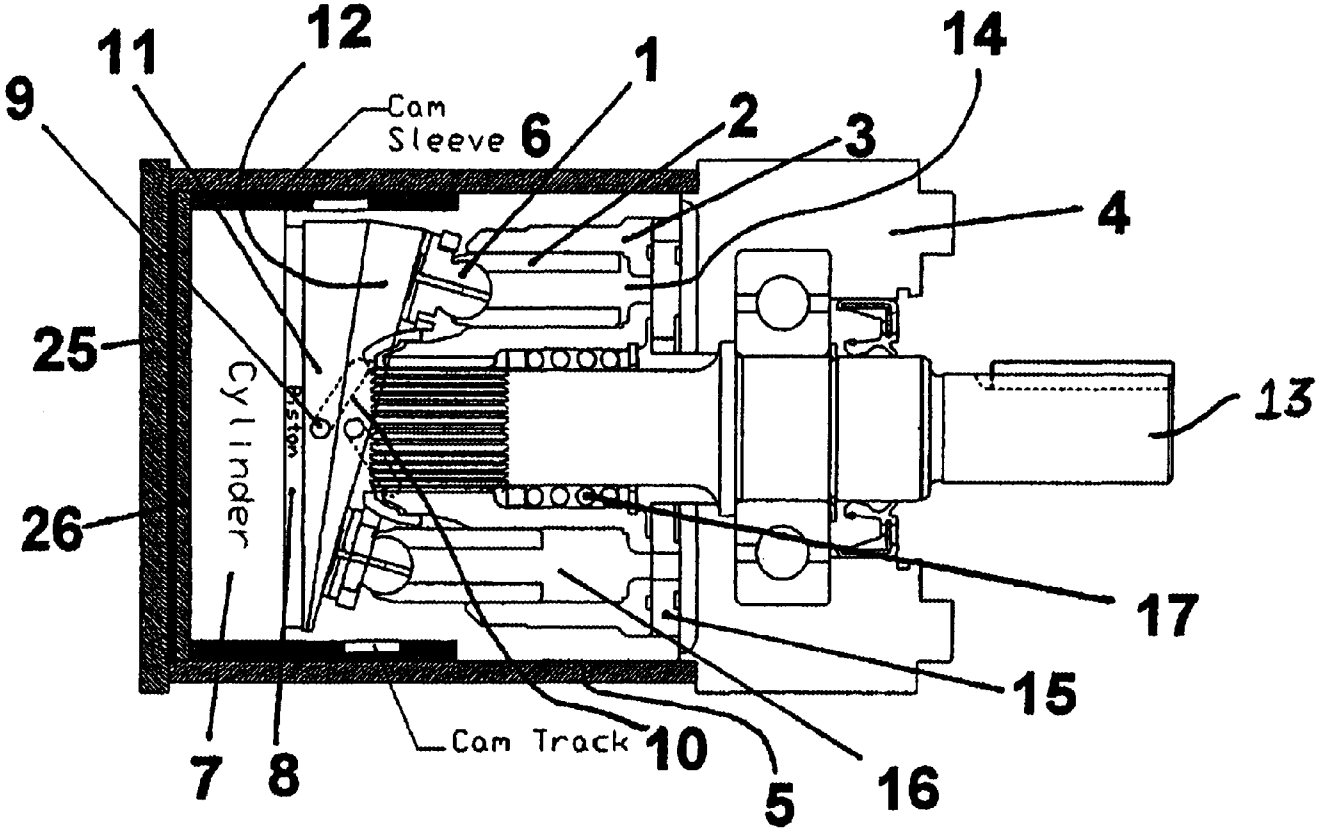
FIG. 1 is a cross section of a conventional axial pump retrofitted using a stroke control assembly and a double wedge tilt platform of the present invention at maximum stroke.

FIG. 1 is a composite that shows components from an existing hydraulic pump (piston shoes 1, pistons 2, cylinders 3 and output block 4), a modified housing member (including a simplified case 5 and end plate 25), a stroke control assembly of the instant invention (Cylinder member 7 and Piston member 8), a double wedge assembly (lower wedge member 11 and upper wedge member 12), a means for controlling rotation of said wedge members (Cam sleeve 6, Cam 9 and Cam Track 10) and a means of controlling clearance volume 26.

FIG. 1 shows a very simple, novel combination of a double wedge assembly and a stroke assembly, which consists of a base member cylinder 7, a control piston member 8 and mechanical linkage 9, 10 for wedge rotation. The advantages of the new combination are the very simple mechanical linkage, a compact control piston 8 with a large surface area (lower actuation pressures) and an assembly that can maintain a constant clearance volume at top-dead-center 14. Clearance volume is based on the minimum distance between the head of a pumping cylinder 3 and the head of a pumping piston 2 during one rotation of a pumping piston as exemplified by the upper piston shown in FIG. 1. A further advantage is that the addition of a moveable cam sleeve 6, as an additional housing member, allows for the clearance volume 14 to also be changed dynamically and independent of any change in stroke. Please note that the double wedge assembly itself is stationary and there are no rotating seals, ports, or manifolds.

The double wedge assembly is simple. It consists of two circular wedges 11, 12, which are fixed together such that one or both can rotate about the centerline, and a means to rotate one or both wedges. Rotation of the wedges causes the uppermost surface of the assembly to tilt from a position perpendicular to the drive shaft 13 to an angle that is determined by the incline angles of the edges. Hugelman (U.S. Pat. No. 5,724,879) provides a detailed description of a double wedge assembly for control of stroke in axial pumps.

It is an object to this invention to provide a control system, method and apparatus for axial devices in which a double wedge assembly, which provides a flat tiltable surface, includes a second rotatable wedge member 12 which is rotatably mounted on a first rotatable wedge member 11. The first rotatable wedge member 11 is rotatably supported by the piston member 8 of the stroke control assembly. The piston member 8 is received by the base member cylinder 7 of the stroke control assembly. The second wedge member 12 engages pumping piston shoe 1, piston 2 and cylinder 3 assemblies as the shaft 13 rotates. The second wedge member 12 is rotatable through various positions relative to the first wedge member 11, thus providing an adjustable tilt angle and varying strokes for the pistons 2.

In another embodiment, the stroke control assembly and the double wedge assembly are not fixed to the housing end plate 25, but allowed to move with respect thereto. Rather the stroke control assembly and the double wedge assembly are separated from the housing end plate 25 by a clearance volume control assembly 26 such as an electrically or manually controlled screw jack, an independently controlled cylinder and piston or a flexible bladder.

Operation as a Variable Displacement Compressor

One skilled in the art would recognize the modifications of the conventional pump components shown in FIG. 1 necessary to operate the device as a compressor, e.g., modifications to the port plate 15 and pistons 2, and to provide typical means for compressor lubrication.

FIG. 1 shows the configuration at maximum stroke. The wedges 11,12 have pins or cams 9 fixed solidly to them that protrude into side cavities or recesses 10.

By changing the slope of the pin guide cavities 10, the clearance volume 14 can be fixed or profiled to follow a given stroke/clearance curve. These pin guide cavities 10 may be located in the housing member, for example, either the case 5 (fixed profile stroke/clearance volume) or a moveable cam sleeve 6 (independently variable stroke/clearance volume). The control piston 8 in this case is also circular and its surface makes sliding contact with the bottom surface of the lower wedge 11. The lower wedge 11 is allowed to rotate on the control piston 8 surface. Hydraulic pistons of the general shape of the stroke control assembly are commercially available.

To reduce stroke, control fluid under pressure is supplied to the control cylinder 7 thereby forcing the control piston 8 to extend from the control cylinder 7. This force causes the lower wedge 11 to move forward toward the rotating cylinder block 3. This forward motion is restricted by the pins 9 to follow the guide cavity 10 for the lower wedge such that the lower wedge 11 rotates until the control piston 8 stops. This process also occurs with the upper wedge 12 as it also moves forward toward the rotating cylinder block 3. But in this case the pin 9 and cavity 10 for the upper wedge 12 are positioned such that the upper wedge 12 rotates counter to lower wedge 11 until the control piston 8 stops. The forward motion of the wedge assembly, combined with the counter rotating wedges, reduces the head volume at the bottom-dead-center position 16 of the rotating pistons 2 until it is the same as the clearance (head) volume 14 at the top-dead-center position (or any other desired profile), i.e., until the tiltable surface of the double wedge assembly is at zero tilt with respect to the aforesaid axis of rotation.

To increase stroke, control fluid is removed from the control cylinder 7. This allows the control piston 8 to retract into the control cylinder 7 thereby reversing the process described for reducing stroke. There would be two forces against the upper surface of the wedge assembly to accomplish or assist the backward motion of the wedge assembly and concurrent increase in stroke of the rotating pistons 2. The first is from the spring 17 that holds the rotating piston shoes 1 in contact with the upper surface of the wedge assembly. The second results from the pump pressure acting on the piston area.

Note that the return force due to pump pressure on the piston area is quite large. The low pressure side has little effect even if a vacuum. This means that a gas compressor can be expected to perform in a similar manner to the hydraulic configuration.

Other means of rotating the lower wedge 11 and causing forward or reverse motion of the wedge assembly are possible. For example, electrical stepper motors could be used, thereby allowing direct integration with any computer interface. See also U.S. Pat. No. 5,724,879.

Operation as a Variable Displacement & Variable Clearance Volume Compressor

One means by which these features can be achieved is by addition of a moveable cam sleeve 6 and a control cylinder 26. The pin guide cavities 10 noted above are located in the cam sleeve 6 rather than the case 5.

When the control piston 8 and cam sleeve 6 move along the axis of rotation as a single unit, there is no rotation of the wedges. This means that the clearance volume 14 can be increased or decreased without changing the stroke of the rotating pistons 2.

When the cam sleeve 6 is fixed, the stroke of the rotating pistons 2 can be changed as described above. But in this case the clearance volume 14 is determined by the position of the cam sleeve 6.

When both the cam sleeve 6 and control piston 8 move, to different forward or backward positions, it will be possible to change the position of the rotating pistons 2 at bottom-16 and/or top-14 dead-center. Alternatively, the distance that control piston 8 moves to provide zero tilt to the double wedge assembly can be adjusted to coincide with the forward most position of cam sleeve 6, thereby again making it possible to change the position of the rotating pistons 2 at bottom-16 and/or top-14 dead-center.

Movement of cam sleeve 6 can be actuated by a second control cylinder and piston assembly 26 that supports the cam sleeve 6 and the stroke control cylinder 7 and controls clearance volume 14. The upper cylinder 7 raises and lowers the double wedge assembly changing the stroke and following any previously determined clearance profile as before. Any movement of the lower clearance volume control piston raises or lowers the cam sleeve 6 and the stroke control cylinder 7, thereby decreasing or increasing the clearance volume 14, respectively, as desired without changing stroke. Again, electric stepper motor driven screw jacks could replace the clearance volume control assembly. Also, for a $CO_2$ compressor useful in air-conditioning and refrigeration systems, typical operating pressures may be adequate for proper actuation using gas control cylinders. This is due to the high $CO_2$ pressures available, the density of $CO_2$ at high pressure and the large actuator cylinder piston areas unique to this mechanism.

Another means by which these features can be achieved is by addition of a moveable cam sleeve 6, a means for moving cam sleeve 6 plus a means for controlling the distance stroke control piston member 8 travels to achieve zero tilt of the double wedge assembly. Movement of cam sleeve 6 may be achieved by slidably affixing cam sleeve 6 to case 5 and connecting said cam sleeve 6 to a means for moving said cam sleeve 6 including an electric stepper motor or manually adjusted screw jack or a hydraulic piston cylinder assembly. The position of cam sleeve 6 will determine the position of the double wedge assembly at zero stroke. As before, the pin guide cavities 10 are located in the cam sleeve 6 rather than the case 5. One skilled in the art will recognize means for controlling the distance stroke control piston member 8 travels to achieve zero tilt.

Rotating Cylinder Block vs. Rotating Wobble Plate in a Gas Compressor

Axial piston gas compressors traditionally utilize a rotating wobble plate, fixed cylinder block, separately ported cylinders and reed valves. There is no apparent reason to believe that the instant axial piston compressor, e.g., as in FIG. 1, which uses a fixed "wobble plate", rotating cylinder block and a port plate, would be less efficient than an existing axial piston compressor for $CO_2$, see U.S. Pat. No. 5,894,782.

In a compressor of the instant invention, the intake side of a compressor port plate would be similar to that used in a hydraulic pump. The typical kidney shaped port on the intake side of the plate need not be changed. The typical kidney shaped port on the compression side of the plate would be reduced in length to the equivalent of a circle. The net result during compression is the outlet port would be "closed" until the gas in the cylinder is compressed to the high-side operating pressure. At maximum pressure a piston would pass across the outlet port to allow passage of the compressed gas into the high-pressure side manifold. Because $CO_2$ air-conditioning and refrigeration systems operate as a transcritical gas cycle, there is essentially no danger of slugging and damage of the compressor by this modification of the port plate.

Electronic Control

Hydraulic actuation is a pressure/force based control system and has natural friction, which creates a "dead zone" or hysteresis in the control action. Builders go to great length to reduce friction so as to minimize this adverse condition.

An electric drive using a simple stepper motor is a position-based device not a force-based device. Thus, such an electronic controller would have zero hysteresis. Friction has no affect. A pressure transducer may be necessary to provide the output data for processing and controlling the stepper motor, creating an ideal interface with a computer.

For $CO_2$ gas compressors an electronic version may be a key feature. For gas operation, hydraulic fluids may not be readily available for stroke or clearance volume control actuation—an exception might be the power steering pump in vehicle applications. Since air-conditioning systems in such vehicles will certainly be electronically controlled (as they already are) provision for electronically controlled $CO_2$ compressor for air-conditioning may prove advantageous.

Spherical Base Wobble Plate

In another embodiment of the instant invention, the double wedge means for controlling the tilt angle of the wobble plate may be replaced with a spherical, or otherwise convex, base attached to the wobble plate and a conforming piston head.

Figure 4:
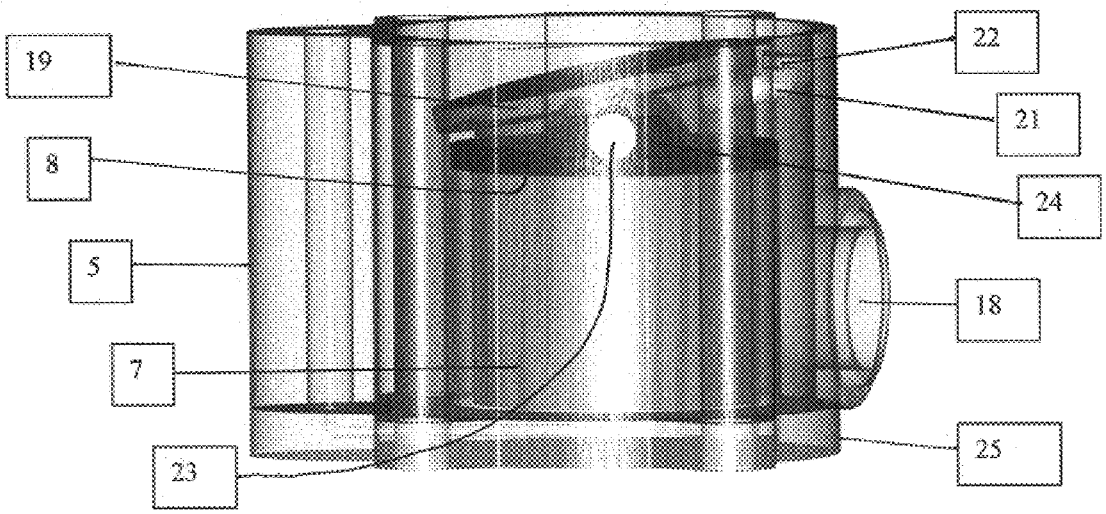
FIG. 4 is a three-dimensional rendering of the stroke control assembly and spherical ball tilt platform of FIG. 2 enclosed within a case suitable for direct attachment to the head of an existing hydraulic pump.

This mechanism can be used with existing axial devices (see for example FIG. 1). In one example, an existing pump is driven from a single cantilever shaft 13, which allows for a completely open base section of a pump case 5 (see FIG. 4). A head section 4 contains all the working parts of the pump, is very compact and ports the high-pressure output only. A bottom section 5 is ported for a low-pressure inlet 18 (see FIG. 4) with oil filling the interior of the pump and supercharged as it passes through a rotating cylinder barrel 3 to a port plate 15 in a head 4. This permits the replacement of the case section and wobble plate of the existing pump with a new pump case 5 (see FIG. 4) and a control assembly of the instant invention. The design freedom permitted in this way leads to a very simple approach with the only moving parts being the wobble plate 19 itself and the actuating piston 8 that moves it. This design will allow simultaneous control of both pumping piston stroke and clearance volume. One skilled in the art will recognize alternative means typically used to port working fluid through an axial device.

It is another object of the invention to provide a control system, method and apparatus in which a spherical ball 20 and wobble plate 19 assembly are slidably mounted on a control piston 8. The spherical ball 20 and wobble plate 19 assembly includes a flat surface that engages the working piston shoe 1, piston 2 and cylinder 3 assembly as the shaft 13 rotates. Movement of the control piston 8 controls movement of the spherical ball 20 and wobble plate 19 assembly to adjust the angle formed by the axis of rotation of the working pistons 2 and the flat surface of the spherical ball 20 and wobble plate 19 assembly to control movement of the working pistons 2, thus providing an adjustable tilt angle and varying strokes for the pistons 2.

Figure 2:
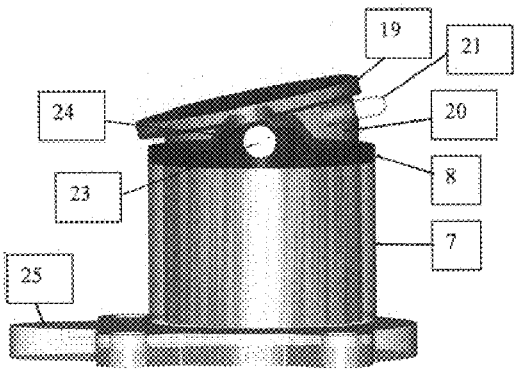
FIG. 2 is a three-dimensional rendering of a stroke control assembly and a spherical ball tilt platform of the present invention at maximum stroke.
Figure 3:
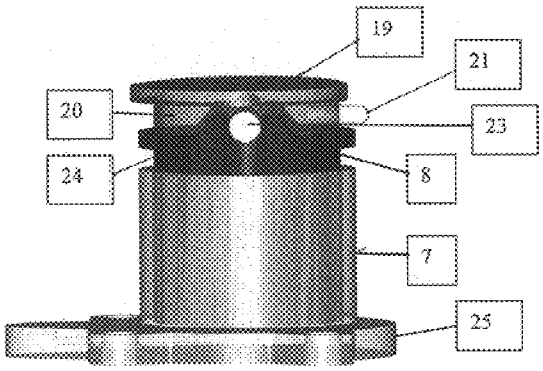
FIG. 3 is a three-dimensional rendering of the stroke control assembly and spherical ball tilt platform of FIG. 2 at zero stroke.

FIGS. 2 and 3 demonstrate how the concept works. A spherical ball is segmented as shown and the wobble plate 19 attached to a segment of the spherical ball 20. The spherical ball segment 20 rides in a conforming socket in the head end of the short actuator piston 8. The spherical ball 20 is sized so that about 25% of the output pressure (typical control pressure to move the piston) will "float" the spherical ball 20—the assembly is thus suspended on a friction free hydrostatic bearing. Oil to the ball may be delivered from the actuator cylinder 7, through the base of the piston 8 and through a small orifice to the suspension socket. Sizing the spherical ball 20 is important. If too large, excessive oil will be forced out and around the ball. If too small, the pump forces will exceed the hydrostatic suspension and the ball will be squeezed into the socket shutting off the orifice leaving a dry socket. Oil leakage allowed into the case will be inconsequential. One skilled in the art will recognize that other means and shapes, including a segment of a cylinder and other segments of a spherical ball, could be used to provide functionally equivalent sliding contact with the actuator piston 8. One skilled in the art will also recognize that the spherical ball 20 and wobble plate 19 may otherwise be manufactured as a single piece, including machining or powdered metal processes.

The thrust axis of the pump is typically offset from the wobble plate pivot axis. This offset will rotate the ball 20 until a tilt stop pin 21, fixed to or manufactured as part of, the ball 20 contacts a lip 22 on the case 5. Location of the lip 22 and the tilt stop pin 21 are such that the wobble plate 19 is at the required maximum tilt angle at start up. As the control piston 8 moves upward the tilt stop pin 21 forces the wobble plate 19 to reduce stroke (tilt) until zero stroke is reached (FIG. 3). There is minimal load on the tilt stop pin 21, which is comfortably over-designed as shown in the figures. Note that the wobble plate 19 is always exactly timed—there is no off-time tilt to the wobble plate as may occur with the double wedge control means where one of the wedges is fixed. The double wedge assembly described above is also exactly timed.

Since the suspension is a ball 20, it is free to drift on all axes. To prevent this, one means is to drill a hole on an axis of the ball as shown. A fitted shaft 23, which extends through and beyond the circumference of the spherical ball, rests on saddles 24 machined in, or otherwise made a part of, the edge of the piston flange 8. This constrains rotation of ball 20 to the axis of choice and prevents the ball 20 from rolling about an axis perpendicular to the pivot axis. This is only to stabilize the tracking of the ball 20, and the shaft 23 need not carry any load of significance. This rotation may also be constrained through use of a conforming piston 8 and a cylinder segment, or a similarly shaped spherical ball segment, as an alternative to the combination of a spherical ball 20 and through shaft 23.

The location of the center of the wobble plate 19 is offset from the centerline of the spherical ball 20. This offset is parallel to the tilt axis. This is very different from typical axial pumps where the axes are on center. Their very large tilt plate shaft and support bearings have to be able to carry the full thrust load of the pump at maximum output pressure and any offset load is simply endured. Since the pistons 2 are at full pressure during half the rotation of the cylinders 3 and at suction pressure on the inlet half of the cycle, the thrust force vector is not on the axis of rotation of the pump shaft but significantly offset. The location can be calculated. By moving the centerline of the ball 20 to coincide with the thrust axis, the ball 20 will hydrostatically support the wobble plate 19 directly under the pumping thrust axis—the through shaft 23 and saddle 24 need carry no load. The pumping thrust axis of a typical axial device varies according to the length of the port plate and the number of cylinders open to the port at any given time. Therefore, the centerline of the ball 20 would be positioned so as to be encompassed by the full range of motion of the pumping thrust axis.

Finally, pumping torque would cause the ball 20 to spin the actuator piston 8 in its cylinder 7. To prevent this and to absorb the pump torque, one means is to have the ball through shaft 23 extend beyond the actuator cylinder 7 and be captured in vertical side slots on the case wall 5. Little precision is required. As the ball 20 is moved up and down, changing the stroke, the through shaft 23 rides within the guide slot. Pump torque on the wobble plate 19 tries to rotate the wobble plate 19 but the torque is held by the through shaft 23 within the guide slot.

It will be obvious to one skilled in the art to either modify existing hydraulic tilt cylinder control systems or to create a new system for moving the stroke control piston and spherical ball wobble plate and thereby controlling stroke of the pump. It will also be obvious to one skilled in the art that the stroke control piston could be raised and lowered by independent means such as electrically by means including a jack screw, and that the stroke control piston and spherical ball assembly could be designed so as to not require lubrication, be pre-lubricated or be lubricated by an independent hydraulic supply.

In the instant invention the spherical ball 20 and wobble plate 19 are machined as one unit whereas in other embodiments they may be formed as one unit from powdered metal or manufactured separately and then fixedly attached.

In the instant invention, the spherical ball 20 and wobble plate 19 incorporate a tilt stop pin 21, which contacts a protrusion 22 on the case 5, to control movement of the ball 20 within the control piston 8 and the tilt angle of the wobble plate 19 whereas in other embodiments other means of contact between the spherical ball 20 and wobble plate 19 and the case 5 may be provided.

In the instant invention, the spherical ball 20 and wobble plate 19 incorporates a steel ball key through shaft 23, which contacts saddles 24 machined in the edge of the control piston 8 flange, to control movement of the ball 20 within the control piston 8 and prevent the ball 20 from rolling about an axis perpendicular to the pivot axis whereas in other embodiments other means of contact between the spherical ball 20 and wobble plate 19 and the control piston 8 may be provided.

In the instant invention, the steel ball key through shaft 23 extends beyond the control piston 8 and is captured in vertical guide slots on the case 5 wall to control movement of the control piston 8 within the base member 7 of the control piston assembly whereas in other embodiments other means of contact between the spherical ball 20 and swash plate 19 and the case 5 may be provided.

In the instant invention the slidable means of contacting the control piston 8 is a spherical ball 20 whereas in other embodiments a cylindrical segment, wherein the diameter of said cylindrical segment is functionally equivalent to the diameter of the spherical ball 20, may be provided.

In the instant invention the centerline of the control piston 8 is directly under the pumping thrust axis of the pump whereas in other embodiments the control piston 8 may be concentric with the axis of rotation of the pump shaft 13.

In the instant invention lubrication between the spherical ball 20 and the control piston 8 is provided through an orifice in the control piston 8 whereas in other embodiments, the spherical ball 20 and control piston 8 may be manufactured with low friction surfaces wherein no lubrication is required.

In another embodiment of the instant invention a clearance volume control assembly may be provided as with the double wedge assembly, such as in 26, FIG. 1, or a combination of a means for moving lip 22 along an axis that is parallel to said axis of rotation, plus a means for controlling the distance stroke control piston member 8 travels to achieve zero tilt of the spherical ball wobble plate assembly. Movement of lip 22 may be achieved by slidably affixing lip 22 to case 5 and connecting lip 22 to a means for moving lip 22 including an electric stepper motor or manually adjusted screw jack or a hydraulic piston cylinder assembly. The position of lip 22 will determine the position of the spherical ball wobble plate assembly at zero stroke. One skilled in the art will recognize means for controlling the distance stroke control piston member 8 travels to achieve zero tilt.

Various changes and modifications may be made in the above described system, method and apparatus which will fall within the scope of the following claims.

I claim:

1. Apparatus for controlling an axial device having a drive shaft with an axis of rotation and a plurality of pistons parallel to and surrounding an extension of said shaft of rotation beyond said drive shaft, comprising:

a. a base member encompassing said axis of rotation, b. a control piston adjustably fitted within said base member, and c. a double wedge member assembly rotatably mounted on said control piston and adjustably affixed to a means for controlling rotation of a first and a second wedge member in said double wedge member assembly, said double wedge member assembly including a flat surface, said flat surface being in driving relationship to said plurality of pistons, whereby adjustment of said control piston controls rotation of the first and a second wedge members of said double wedge assembly to adjust the angle formed by said axis of rotation and said flat surface of said double wedge member assembly to control movement of said plurality of pistons.

2. Apparatus according to claim 1 wherein adjustment of said control piston is controlled by means of a fluid.

3. Apparatus according to claim 2 wherein adjustment of said control piston is hydraulically controlled.

4. Apparatus according to claim 2 wherein adjustment of said control piston is controlled by means of a gas.

5. Apparatus according to claim 1 wherein said axial device is a pump.

6. Apparatus according to claim 1 wherein said axial device is a compressor.

7. Apparatus according to claim 1 wherein said axial device is a motor.

8. Apparatus for controlling an axial device having a drive shaft with an axis of rotation and a plurality of pistons parallel to and surrounding an extension of said shaft of rotation beyond said drive shaft, comprising:

a base member encompassing said axis of rotation, a control piston adjustably fitted within said base member, said control piston being in driving contact with a means for adjustably tilting a flat surface, said flat surface being in driving relationship to said plurality of pistons, and further comprising a spherical ball and wobble plate assembly slidably mounted on said control piston, said spherical ball and wobble plate assembly including said flat surface being in driving relationship to said plurality of pistons, whereby adjustment of said control piston controls and adjusts the angle formed by said axis of rotation and said flat surface of said spherical ball and wobble plate assembly to control movement of said plurality of pistons.

9. Apparatus according to claim 8 wherein said spherical ball and wobble plate are fixedly attached.

10. Apparatus according to claim 8 wherein said spherical ball and wobble plate are one unit.

11. Apparatus according to claim 8 wherein a cylindrical segment replaces said spherical ball segment in said wobble plate assembly.

12. Apparatus according to claim 8 wherein the centerline of said control piston is encompassed by the full range of motion in the pumping thrust axis.

13. Apparatus according to claim 8 wherein said spherical ball and said control piston are manufactured with low friction surfaces.

14. A method of controlling an axial device having a drive shaft with an axis of rotation and a plurality of pistons parallel to and surrounding an extension of said axis of rotation beyond said drive shaft, comprising:

a. providing a base member encompassing said axis of rotation, b. providing a control piston adjustably fitted within said base member, c. connecting said shaft to said plurality of pistons to rotate said plurality of pistons and shaft with respect to said base member, said control piston and said means for adjustably tilting a flat surface, and d. providing a double wedge member assembly rotatably mounted on said control piston and adjustably affixed to means for controlling rotation of a first wedge member and a second wedge member in said double wedge member assembly, said double wedge member further including a flat surface being in driving relationship to said plurality of pistons, whereby adjustment of said control piston controls rotation of said first and a second wedge member of said double wedge assembly, and moving said control piston to change the angle formed by said axis of rotation and said flat surface of said double wedge member assembly to control movement of said plurality of pistons.

15. Apparatus for controlling an axial device having a drive shaft with an axis of rotation and a plurality of pistons parallel to and surrounding an extension of said shaft of rotation beyond said drive shaft, comprising:

a. a clearance volume control member, and b. a base member encompassing said axis of rotation, and c. a control piston adjustably fitted within said base member, said control piston being in driving contact with a means for adjustably tilting a flat surface, said flat surface being in driving relationship to said plurality of pistons, and d. whereby adjustment of said clearance volume control member relative to the head of cylinders receiving said plurality of pistons, controls the minimum distance, between the head of cylinders receiving said plurality of pistons and the head of said plurality of pistons within one rotation of said drive shaft, at which said adjustably tiltable flat surface is at zero tilt with respect to said axis of rotation.

16. Apparatus according to claim 15 wherein said clearance volume control member includes a cylinder and a piston.

17. Apparatus according to claim 16 wherein adjustment of said clearance volume control member is by means of a fluid.

18. Apparatus according to claim 15 wherein said clearance volume control member is adjusted by means of an electric stepper motor.

19. Apparatus according to claim 15 wherein said axial device is a compressor.

20. A method of controlling an axial device having a drive shaft with an axis of rotation and a plurality of pistons parallel to and surrounding an extension of said axis of rotation beyond said drive shaft, comprising:

a. providing a clearance volume control member, b. providing a base member encompassing said axis of rotation, c. providing a control piston adjustably fitted within said base member, said control piston being in driving contact with a means for adjustably tilting a flat surface, said flat surface being in driving relationship to said plurality of pistons, d. connecting said shaft to cylinders receiving said plurality of pistons to rotate said plurality of pistons and shaft with respect to said base member, said control piston and said means for adjustably tilting a flat surface, and e. adjusting said clearance volume control member to change the minimum distance, between the head of cylinders receiving said plurality of pistons and the head of said plurality of pistons, at which said adjustably tiltable flat surface is at zero tilt with respect to said axis of rotation, to control clearance volume.

* * * * *